US005474468A

United States Patent [19]

Chishima et al.

[11] Patent Number: 5,474,468

[45] Date of Patent: Dec. 12, 1995

[54] CONNECTOR

[75] Inventors: Masamitsu Chishima; Kazuhito Saka; Kenji Mizutani, all of Yokkaichi, Japan

[73] Assignee: Sumitomo Wiring Systems, Ltd., Yokkaichi, Japan

[21] Appl. No.: 114,618

[22] Filed: Sep. 1, 1993

[30] Foreign Application Priority Data

| | | | |
|---|---|---|---|
| Sep. 14, 1992 | [JP] | Japan | 4-064051 U |
| Sep. 14, 1992 | [JP] | Japan | 4-064055 U |
| Sep. 25, 1992 | [JP] | Japan | 4-066914 U |
| Sep. 25, 1992 | [JP] | Japan | 4-066915 U |
| Oct. 26, 1992 | [JP] | Japan | 4-074543 U |
| Oct. 26, 1992 | [JP] | Japan | 4-074544 U |

[51] Int. Cl.[6] ..... H01R 9/07

[52] U.S. Cl. ..... 439/495; 439/329; 439/630

[58] Field of Search ..... 439/329, 492, 439/493, 495, 496, 499, 571, 876, 67, 77, 83, 629, 630, 636, 637, 733, 856–858, 869

[56] References Cited

U.S. PATENT DOCUMENTS

| | | | |
|---|---|---|---|
| 4,628,410 | 12/1986 | Goodman et al. | 439/83 |
| 4,629,278 | 12/1986 | Norton et al. . | |
| 4,734,053 | 3/1988 | Imai | 439/329 |
| 4,808,113 | 2/1989 | Kanesige et al. | 439/493 |
| 4,900,268 | 2/1990 | Kunishi | 439/493 |
| 4,921,430 | 5/1990 | Matsuoka | 439/72 |
| 4,969,840 | 11/1990 | Ii et al. | 439/495 |
| 5,104,324 | 4/1992 | Grabbe et al. | 439/876 |
| 5,106,311 | 4/1992 | Yodogawa et al. | 439/492 |
| 5,158,479 | 10/1992 | Mouissie | 439/869 |
| 5,308,262 | 5/1994 | Chishima | 439/495 |

FOREIGN PATENT DOCUMENTS

| | | | |
|---|---|---|---|
| 2643158 | 9/1977 | Germany | 439/733 |
| 297757 | 8/1990 | Japan . | |
| 404034880A | 2/1992 | Japan | 439/630 |
| 4206175 | 7/1992 | Japan . | |
| 2168858 | 6/1986 | United Kingdom . | |

*Primary Examiner*—Steven C. Bishop

*Attorney, Agent, or Firm*—Sandler, Greenblum & Bernstein

[57] ABSTRACT

A connector comprises a plurality of forked terminals, an insulating housing, a flat cable and a slide member. The terminals are inserted into the housing from an opening disposed at one side of slit-shaped through-openings arranged in parallel with each other. The flat cable and the slide member are inserted into the housing from an opening disposed at the other side of the through-openings. A pressing portion projecting from a base plate portion of the slide member presses the flat cable against the terminals. The area of a contact portion of each terminal is great to secure the connection between conductors of the flat cable and the terminals.

7 Claims, 12 Drawing Sheets

Fig. 13 (A) PRIOR ART
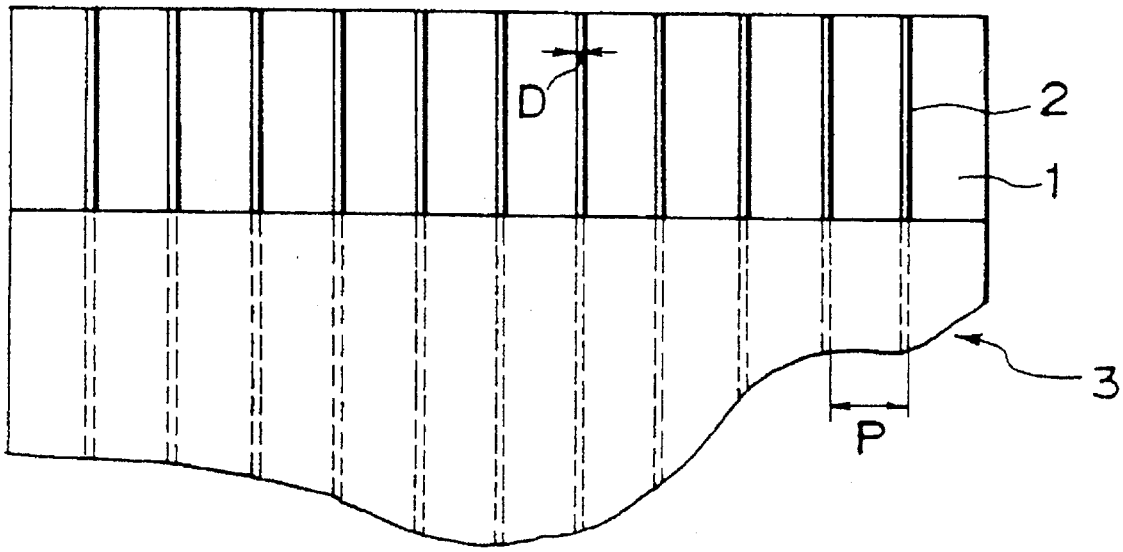
Fig. 13 (B) PRIOR ART
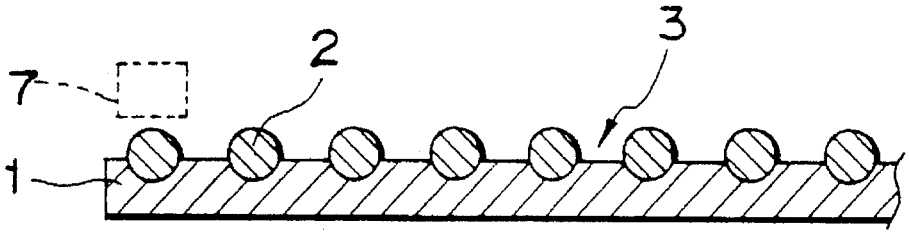

Fig. 14 PRIOR ART
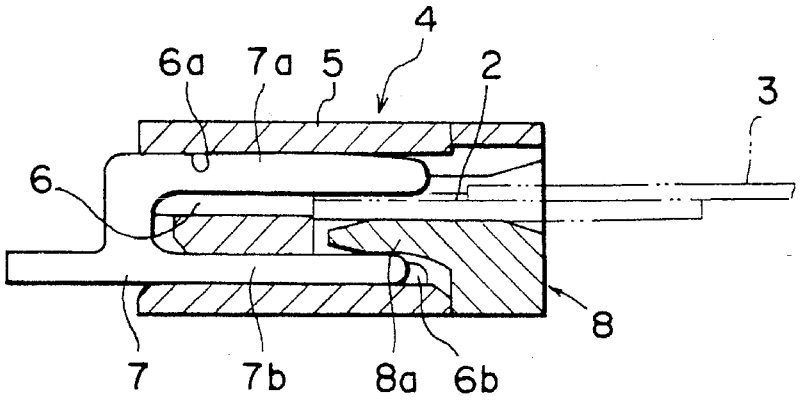
Fig. 15 (A) PRIOR ART
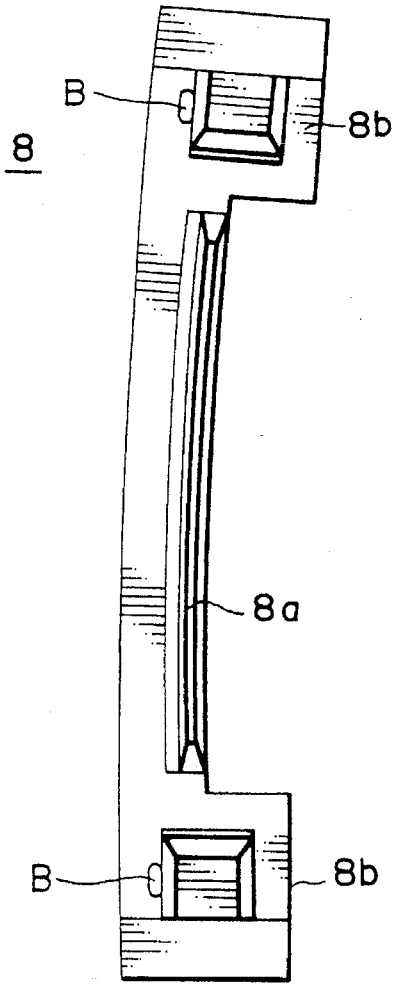
Fig. 15 (B) PRIOR ART
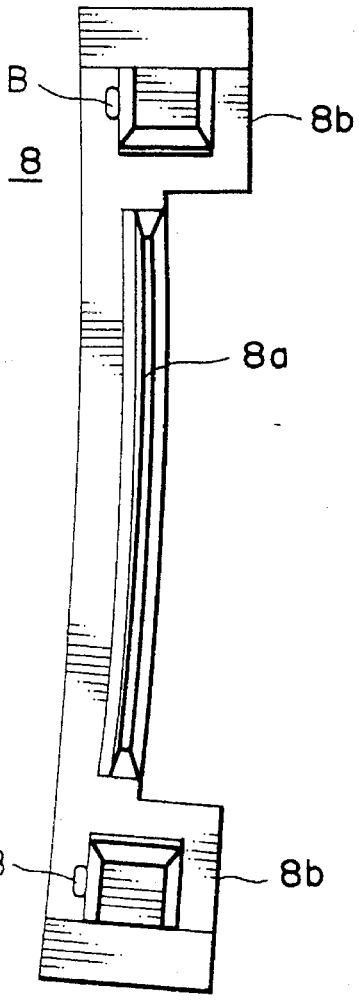

CONNECTOR

BACKGROUND OF THE INVENTION

1. Field of the Invention

The present invention relates to a connector for connecting each of a plurality of forked terminals to each of a plurality of conductors of a flat cable, such as a flexible printed circuit or a ribbon electric wire, which consists of a flexible insulating sheet and printed conductors or thin wire conductors spaced in parallel with each other on at regular intervals on the sheet.

2. Description of the Related Arts

In recent years, a flat cable 3 as shown in Figs. 13A and 13B has been proposed. The flat cable 3 comprises a flexible insulating sheet 1 and conductors 2 spaced at regular intervals on the upper surface of the flexible insulating sheet 1. The conductor 2 is set to be as fine as approximately 0.1 mm in its diameter. The interval between adjacent conductors 2 is set to be as small as approximately 0.8 mm. Accordingly, the flat cable 3 is preferably used as an internal wiring material of household electrical appliances such as a VCR, a video camera and the like, and office automation appliances which are desired to be thin and compact.

Each conductor 2 of the flat cable 3 is connected with a forked terminal formed by punching a conductive metal plate. FIG. 14 shows an example of a connector for connecting the conductor 2 of the flat cable 3 and the forked terminal 7 with each other.

In the connector 4, a plurality of slit-shaped terminal-receiving openings 6 are formed in a cubic insulating housing 5 made of synthetic resin. The slit-shaped terminal-receiving openings 6 are spaced from each other at regular intervals in the longitudinal direction of the housing 5. A forked terminal 7 is inserted into each terminal-receiving opening 6. A flat cable 3 and a slide member 8 are inserted into the space between a contact arm 7*a* of the terminal 7 and a positioning arm 7*b* thereof to allow a pressing portion 8*a* of the slide member 8 to press the flat cable 3 against the contact arm 7*a*.

In the above-described connector 4, an incomplete connection is likely to occur between the terminal 7 and the conductor 2 of the flat cable 3.

That is, the conductor 2 and the contact arm 7*a* of the terminal 7 are in contact with each other. But as described above, the diameter of the conductor 2 is very small and in addition, the contact arm 7*a* contacts the conductor 2 in a small area because the width of the contact arm 7*a* is equal to a small width of the terminal 7. Accordingly, if the interval between adjacent terminals 7 does not coincide with that between adjacent conductors 2 or if the intervals between adjacent conductors 2 are nonuniform or if the intervals between adjacent terminals 7 are nonuniform, an incomplete connection is likely to occur between the conductor 2 and the terminal 7.

The contact arm 7*a* of the terminal 7 and the positioning arm 7*b* thereof are inserted into each of openings 6*a* of the terminal-receiving opening 6 and each of openings 6*b* thereof. The slide member 8 presses the flat cable 3 against the contact arm 7*a*, thus holds the flat cable 3 inside the housing 5. But the connector 4 has no means for placing the terminal 7 in position inside the housing 5. Therefore, it is likely that the terminals 7 are inserted at different positions inside the housing 5. As a result, the flat cable 3 is pressed against the terminals 7 at different pressures.

The slide member 8 is installed in the housing 5 in the direction in which the openings 6 are arranged from the side opposite to the terminal-inserting side. Each of a pair of holding portions 8*b* projecting from each end of the slide member 8 in the longitudinal direction thereof is fixed to each end of the housing 4 disposed in the longitudinal direction thereof.

In recent years, the connector 4 has become longer owing to the increase in the number of the openings 6 to be formed in parallel with each other in the housing 5 caused by demands for multipolarization. Hence, the slide member 8 has become longer.

As a result, it is likely that the pressing portion 8*a* comprising thin plates disposed between both holding portions 8*b* are flexed as shown in FIGS. 15A and 15B.

The pressing portion 8*a* presses the conductors 2 of the flat cable 3 against the terminal 7. Therefore, when the pressing portions 8*a* is flexed, there is a possibility that pressures applied by the pressing portion 8*a* to the conductors 2 are different from each other depending on the flexure degree of the pressing portion 8*a* or some conductors 2 are not brought into contact with the corresponding terminal 7.

Insulating resin is integrally molded by a mold to form the slide member 8. Upon completion of molding, the molded insulating resin is ejected by an ejector pin from the mold. It is necessary to form a portion to be ejected by the ejector on both holding portions 8*b*. Due to the ejection of the molded insulating resin, a burr (B) is formed on the ejected portion. The burr (B) projecting from the surface of the holding portions 8*b* prevents the slide member 8 from closely contacting the housing 5. As a result, there is a possibility that the loose contact between the housing 5 and the slide member 8 prevents the conductor 2 from being appropriately pressed against the terminal 7. The burr (B) can be removed from the slide member 8 by polishing it, but it takes time and labor, which causes the connector 4 to be manufactured at a high cost.

Referring to FIGS. 16 and 17, the case in which the connector 4 is soldered to a base plate 9 is considered below.

The connector 4 shown in FIG. 16 is soldered by using a U-shaped holder 101 as follows: The holder 101 comprises an upper holding portion 101*a* disposed on the upper surface of the housing 5, a lower holding portion 101*b* disposed on the lower surface thereof, and a side holding portion 101*c* disposed on the side surface thereof. The holder 101 is fixed to both sides of the housing 5, and the lower holding portion 101*b* of the holder 101 is soldered to a pad 9*a* disposed on a base plate 9. In this manner, the housing 5 is fixed to the base plate 9.

The connector 4 shown in FIG. 17 is soldered by using a U-shaped holder 101' as follows: The holder 101' is engaged by a U-shaped engaging groove 5'*a* formed in the vicinity of both side surfaces of a housing 5'. A lower holding portion 101'*b* of the holder 101' is soldered to the pad 9*a* disposed on the base plate 9. In this manner, the housing 5' is fixed to the base plate 9.

In the connector shown in FIG. 16, the lower holding portion 101*b* of the holder 101 is disposed on the lower surface of the housing 5, i.e., the lower holding portion 101*b* is interposed between the lower surface of the housing 5 and the pad 9*a*. Therefore, the lower surface of the housing 5 is not in close contact with the base plate 9 and hence the housing 5 cannot be tightly fixed to the base plate 9.

The holder 101 is installed on both side surfaces of the housing 5. So long as the holding portion 8b of the holder 8 is mounted on the side surfaces of the housing 5, it is difficult to install the holder 101 on the side surfaces of the housing 5 with respect to the size of the side surface of the housing 5.

In the connector shown in FIG. 17, the holder 101' is thin. Therefore, the holder 101' is soldered to the pad 9*a* in a small area and thus there is a possibility that the holder 101' is fixed thereto not in a high strength. If the holder 101' is made to be thick, it is necessary to make the width of the engaging groove 5'*a* large. Consequently, the housing 5' becomes large. If the housing 5' is not made to be large, the terminal-receiving openings are decreasingly formed inside the housing 101'. In addition, the holder 101' is fixed to the housing 5' by engaging the housing 5' with the engaging groove 5'*a* of the housing 5'. Therefore, the holder 101' is not tightly fixed to the housing 5'.

Referring to FIG. 18, in installing the connector 4 on the base plate 9 by an automatic machine, both side surfaces 5*c* and 5*d* of the housing 5 are sandwiched by arms 102*a* and 102*b* of a chuck 102 of the automatic machine. In this state, the center L1 of the chuck 102 and the center L2 of the housing 5 coincide with each other. Therefore, a connector-installing position (X) with which the center L2 of the housing 5 should be coincident is set on the base plate 9 so that the center L1 of the chuck 102 is made to be coincident with the connector-installing position (X). In this manner, the housing 5 is held by the chuck 2. Then, the chuck 102 is moved downward as shown by an arrow (A) of FIG. 19 and the housing 5 is soldered to the pad placed on the base plate 9.

As described previously, the demand for multipolarization of the connector 4 causes the housing 5 to be long in the direction (W) in which the terminal-receiving openings 6 are arranged in parallel with each other. It is necessary to set the side surface 5*d* of the housing 5 at a gate position (G) corresponding to a resin-injecting opening of the mold and inject resin into the mold from the gate position (G) so as to flow the resin smoothly in the mold in the direction corresponding to the longitudinal direction of the housing 5.

A gate remainder 103 is likely to be formed in the gate position (G) as shown in FIG. 19. The side surface 5*d* on which the gate position (G) is formed is held by the chuck 102. Therefore, the center L1 of the chuck 102 and the center L2 of the housing 5 do not coincide with each other due to the existence of the gate remainder 103 when the housing 5 is held by the chuck 102. When the center L1 of the chuck 102 is made to be coincident with the connector-installing position (X) of the base plate 9, the center L2 of the housing 5 does not coincide with the connector-installing position (X). That is, the housing 5 cannot be placed exactly in position on the base plate 9.

After the gate remainder 103 is removed from the gate position (G), the housing 5 can be placed exactly in position on the base plate 9 by the chuck 102 which holds the housing 5. But it is necessary to check whether or not the gate remainder 103 exists on the gate position (G) after the housing 5 has been molded. In addition, it is difficult and inefficient to remove the gate remainder 103 from the gate position (G).

When the housing 5 is to be installed on the base plate 9, the terminals 7 and the slide member 8 have been already installed widthwise in the housing 5. Therefore, it is difficult for the arms 102*a* and 102*b* of the chuck 102 to hold the housing 5 widthwise. Therefore, the side surfaces 5*c* and 5*d* cannot be taken hold of by the arms 102*a* and 102*b* of the chuck 102.

SUMMARY OF THE INVENTION

It is a first object of the present invention to provide a connector in which conductors of a flat cable can be reliably brought into contact with a contact arm of a forked terminal even though the conductor has a small contact area.

It is a second object of the present invention to provide a connector in which the terminal can be inserted into a housing and reliably held at a predetermined position.

It is a third object of the present invention to provide a connector in which a slide member can be prevented from being flexed so that the slide member accomplishes a reliable connection between the conductors of the flat cable and the terminals.

It is a fourth object of the present invention to provide a connector in which the slide member can be smoothly mounted on the housing without removing a burr formed on the slide member when the slide member has been pressed out of a mold by an ejector pin.

It is a fifth object of the present invention to provide a connector in which a holder for fixing the connector to a base plate can be tightly fixed to the housing, the holder can be tightly fixed to the base plate, and the holder can be manufactured at a low cost.

It is a sixth object of the present invention to provide a connector in which even though a gate remainder exists at a gate position in molding the housing in a mold, the housing can be placed in predetermined position exactly on the base plate by an automatic machine.

In accomplishing these and other objects, there is provided a connector comprising: a plurality of terminals formed approximately into a fork configuration; a flat cable provided with a plurality of conductors to be connected with the terminals; an insulating housing into which the terminals and the flat cable are inserted in opposition to each other; and a slide member for pressing each conductor of the flat cable against each terminal.

The terminal formed by punching a conductive metal plate into an approximately forked configuration comprises: a contact arm and a positioning arm projecting horizontally and parallel in the same direction from one side of a vertical connecting portion thereof; and a contact portion having a great area formed on a lower surface of a leading end of the contact arm.

The housing integrally formed out of resin comprises: a plurality of slit-shaped through-openings, extending horizontally and arranged in parallel with each other in the widthwise direction thereof, for receiving terminals from an opening portion disposed at one side thereof and receiving the flat cable and the slide member from an opening portion disposed at the other side thereof, in which the through-openings communicate with each other; and an intermediate wall extending from a terminal-inserting side of the housing into each through-opening, thus partitioning each through-opening into an upper opening for receiving the contact arm of the terminal and having a width enough for the contact portion of each terminal to be inserted therethrough and a lower opening for receiving the positioning arm of the terminal.

The flat cable comprises: a flexible insulating sheet and a plurality of conductors spaced at regular intervals in parallel with each other on the flexible insulating sheet; and is inserted into the housing from the opening portion disposed at the other side of the terminal-receiving through-openings so that the flat cable is disposed between the contact arm and the positioning arm.

The slide member is integrally formed out of resin; and inserted between the flat cable and the positioning arm of each terminal so that the slide member presses the flat cable against the contact portion of the contact arm elastically.

The contact portion comprises projections formed in opposite directions on the lower surface of the leading end of the contact arm. Since the area of the contact portion is great, even a round conductor having a small contact area can be reliably pressed against the terminal.

The width of the upper opening for receiving the contact arm is great to insert the wide contact portion therethrough. The width of the lower opening for receiving the positioning arm is smaller than that of the upper opening so as to hold the terminal in position at the opening.

A first projection and a second projection both are adjacently formed on an upper surface of the positioning arm or a lower surface thereof. The height of the first projection positioned at an inserting side into the opening of the housing is smaller than that of the second projection. According to the above construction, the terminal can be reliably fixed to a predetermined position of the housing.

Engaging projections are formed at the upper end of the vertical connecting portion of the terminal and at the lower end thereof.

Slits are formed at upper and lower portions of each through-opening at a terminal-inserting side thereof. The slits are engaged by the engaging projections, thus stopping the terminal at a predetermined position.

According to the above construction, the terminal can be prevented from moving further from the predetermined position. In this manner, the terminal can be placed in position in the through-opening for receiving the terminal.

The slide member integrally formed out of resin comprises: a base plate portion installed in the housing along the direction in which the through-openings are arranged in parallel with each other; a pressing portion projecting from the base plate portion and inserted between the flat cable and the positioning arm, thus pressing the conductors of the flat cable against the contact arm of the terminal elastically; and a holding portion projecting from both ends of the base plate portion and fixed to a fixing portion formed in the housing, wherein a plurality of holes for preventing the pressing portion from being flexed is formed on the base plate portion.

According to the above construction, even though the slide member is long, the pressing portion thereof can be prevented from being flexed. Consequently, the pressing portion allows the flat cable to be pressed against each terminal at a uniform pressure.

The slide member has a concave portion formed in an area to be pressed out from a mold by an ejector pin.

According to the above construction, even though a burr is formed on the concave portion of the slide member, the burr does not project on the outer side surface which contacts with the housing. Thus, it is unnecessary to remove the burr from the slide member and hence the slide member can be smoothly installed in the housing.

A concave portion of an outer side surface of the housing in the widthwise direction thereof is set as a gate position in correspondence with a resin-injecting opening of a mold.

According to the above construction, in installing the housing on a base plate by a chuck of an automatic machine, a gate remainder formed at the gate position can be prevented from contacting the chuck, and the center line of the chuck can be made to be coincident with that of the housing. The center line of the chuck is made to be coincident with the housing-installing position set on the base plate. Consequently, the center line of the housing coincides with the housing-installing position on the base plate. In this manner, the housing can be placed in position on the base plate exactly.

In fixing the housing to the upper surface of the base plate by using a metal holder, a pair of cut-out openings is formed in the vicinity of both outer side surfaces of the housing in the widthwise direction thereof. The holder is formed by punching a metal plate and inserted into the cut-out opening of the housing. Then, the lower surface of the holder is exposed on the bottom surface of the housing, and soldered to the base plate.

Preferably, the holder is formed out of a metal plate having a thickness equal to that of a metal plate to be shaped into the terminal.

Preferably, a projection is formed on the holder, so that when the holder is inserted into the cut-out opening of the housing, the projection is pressed against an inner surface of the housing.

Preferably, the holder has a concave portion formed on a lower surface thereof so that the holder is soldered to the base plate.

As the holders and the terminals can be formed from the same metal plate, the holder can be manufactured at a low cost. The projection of the holder is pressed against an inner surface of the cut-out opening of the housing, thus allowing the holder to be inserted into the housing smoothly.

The concave portion of the holder stores solder, thus soldering the holder to the base plate at a high strength.

BRIEF DESCRIPTION OF THE DRAWINGS

These and other objects and features of the present invention will become clear from the following description taken in conjunction with the preferred embodiments thereof with reference to the accompanying drawings.

FIG. 13A is a plan view showing a flat cable;

FIG. 13B is a sectional view showing the flat cable;

FIG. 14 is a sectional view showing a conventional connector;

FIGS. 15A and 15B are front views showing a problem of a conventional slide member;

DETAILED DESCRIPTION OF THE INVENTION

Figure 1:
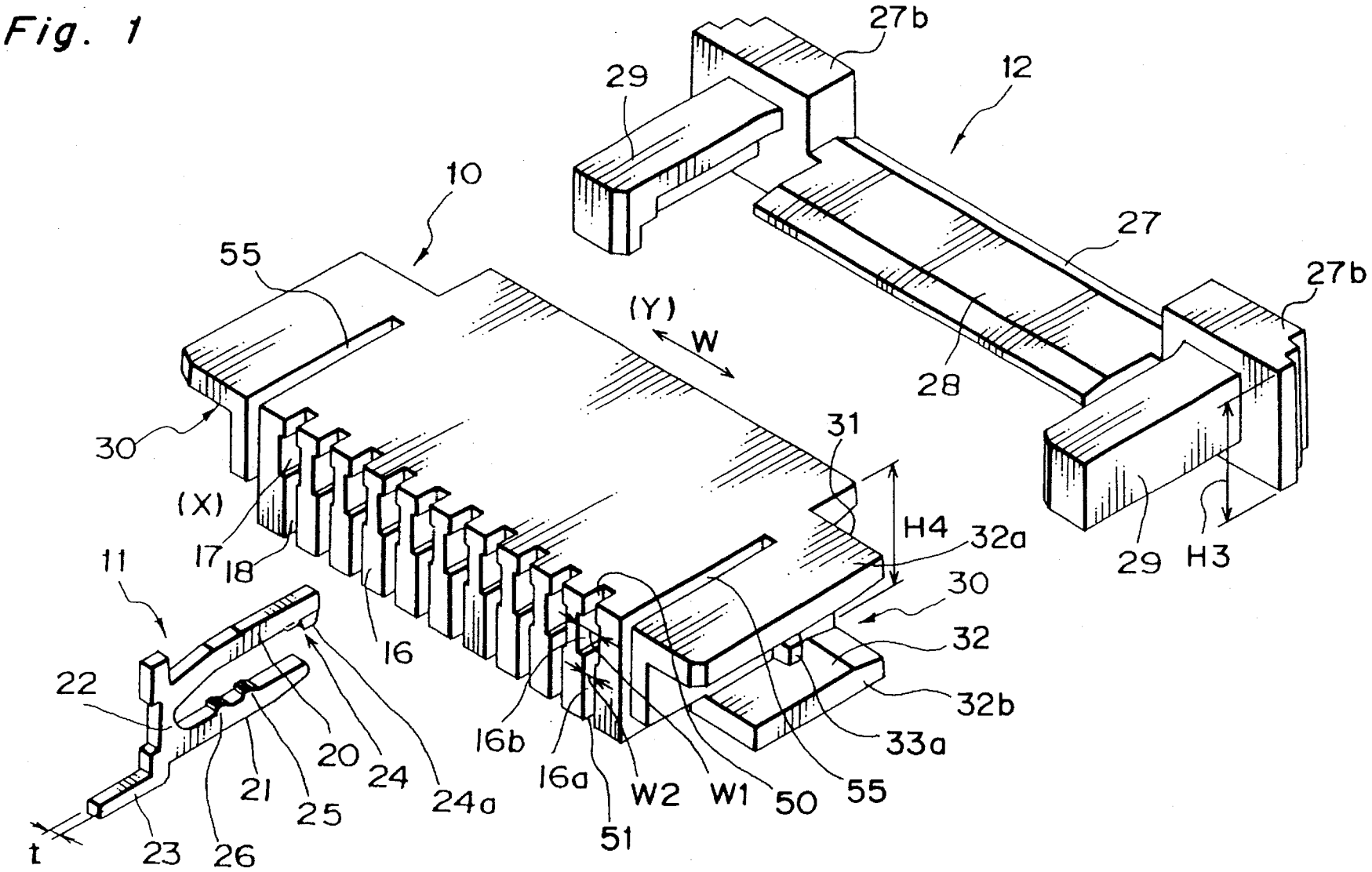
FIG. 1 is an exploded perspective view showing a connector according to a first embodiment of the present invention.

Before the description of the present invention proceeds, it is to be noted that like parts are designated by like reference numerals throughout the accompanying drawings.

The connector according to a first embodiment of the present invention will be described below with reference to FIGS. 1 through 6.

Referring to FIG. 1, the connector comprises a one-piece housing 10 made of insulating resin shaped in a mold; a plurality of forked terminals 11 (one of the terminals is shown in FIG. 1) punched from a conductive metal plate such as a copper alloy uniform in thickness; and a one-piece slide member 12 made of insulating resin shaped in a mold. A flat cable 3 as shown in FIGS. 13A and 13B is used, each round conductor 2 of the flat cable 3 is connected with the terminal 11 respectively.

Figure 3:
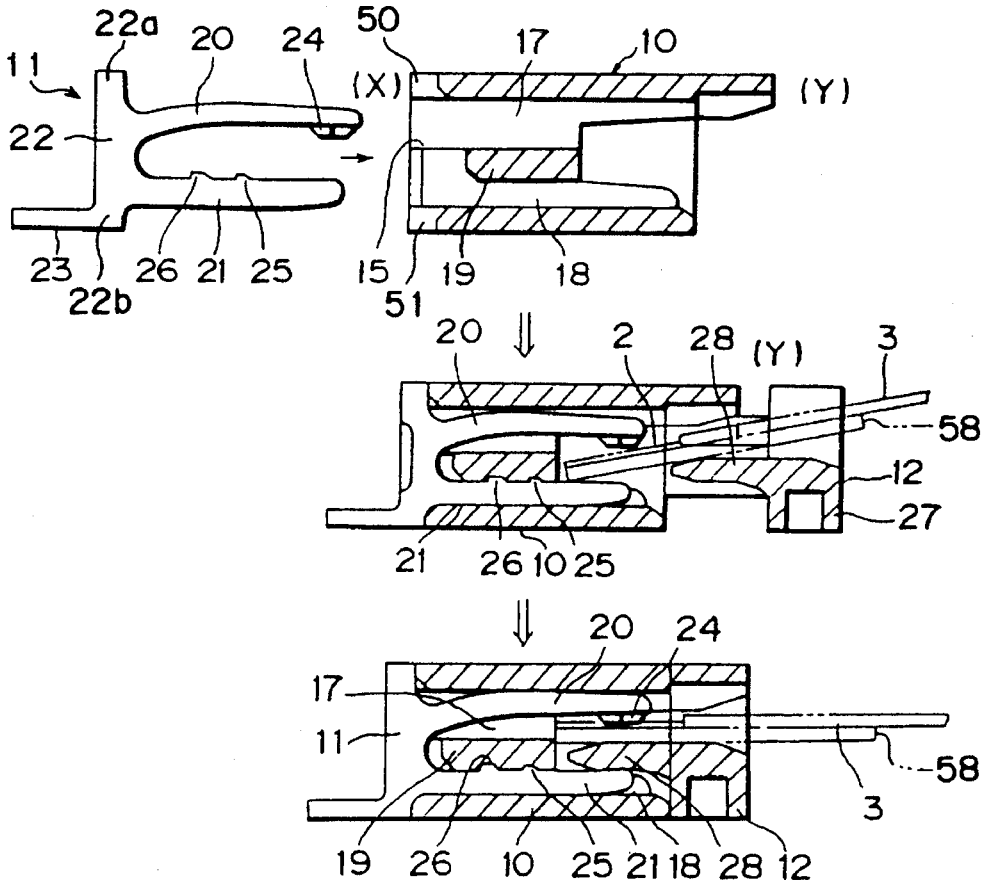
FIG. 3 is a sectional view showing the state in which the connector according to the first embodiment is assembled.

The housing 10 accommodates a plurality of through-openings for receiving the terminal 11, as shown in FIG. 3, arranged horizontally and in parallel with each other. A plurality of vertical partitioning walls 16 interposed between adjacent through-openings 15 extends widthwise from the terminal-inserting side (X) of the housing 10 to approximately the center thereof. A horizontal intermediate wall 19 partitioning the opening 15 into an upper portion and a lower portion is formed in the terminal-inserting side (X). That is, the intermediate wall 19 partitions each opening 15 into an upper opening 17 for receiving a contact arm 20 of the terminal 11 and a lower opening 18 for receiving a positioning arm 21 of the terminal 11. The openings 17 and 18 extend from the terminal-inserting side (X) toward the flat cable 3 and the slide member-inserting side (Y).

As shown in FIG. 1, the width of an upper portion 16*b* of the partitioning wall 16 is set to be smaller than that of a lower portion thereof so that the width W1 of the opening 17 is greater than the width W2 of the opening 18. The width W1 of the opening 17 is greater than the width W3 of a contact portion 24 formed at the leading end of a contact arm 20 of the terminal 11. In this manner, the contact arm 20 can be inserted into the opening 17. The width W2 of the opening 18 is almost equal to the width (t) of the terminal 11 so that the terminal 11 is horizontally placed in position by a positioning arm 21 of the terminal 11.

An upper engaging slit 50 and a lower engaging slit 51 are formed in the opening 15 at the terminal-inserting side (X) thereof.

Figure 2A:
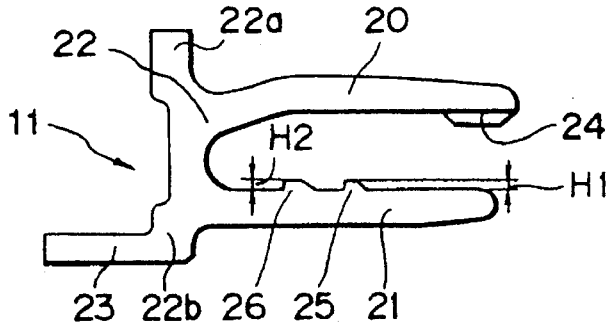
FIG. 2A is a front view showing a terminal according to the first embodiment.

As shown in FIGS. 2(A) and 3, the terminal 11 comprises the contact arm 20; the positioning arm 21 horizontally extending and parallel with the contact arm 20; a vertical connecting portion 22 disposed between the contact arm 20 and the positioning arm 21; and a lead portion 23 extending horizontally from the lower end of the connecting portion 22 in the direction opposite to the extending direction of the contact arm 20 and the positioning arm 21.

Figure 2B:
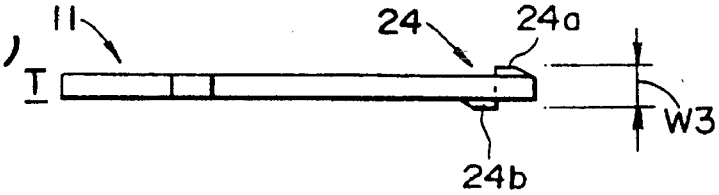
FIG. 2B is a plan view showing the terminal according to the first embodiment.
Figure 2C:
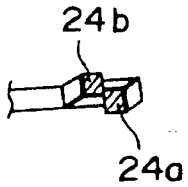
FIG. 2C is an enlarged sectional view showing a principal portion of the terminal according to the first embodiment.

As shown in FIGS. 2B and 2C, there is formed a wide contact portion 24 comprising a pair of projections 24*a* and 24*b* projecting widthwise in opposite directions on the lower surface of the leading end of the contact arm 20. The width W3 of the contact portion 24 is set so that the surface area thereof is about twice as large as that of the width (t) of the terminal 11.

As shown in FIG. 2A, the contact arm 20 is inclined upward in a small degree from the connecting portion 22 and then downward in a small degree.

As shown in FIG. 2A, a first projection 25 and a second projection 26 backward of the first projection 25 are formed in a saw-teeth configuration on the upper surface of the positioning arm 21. The height H1 of the first projection 25, positioned at the inserting side to the opening 15, is set to be smaller than the height H2 of the second projection 26.

As shown in FIG. 2A, in the connecting portion 22, an upper engaging projection 22*a* is formed upward from the contact arm 20 and a lower engaging projection 22*b* is formed downward from the positioning arm 21. The upper engaging projection 22*a* and the lower engaging projection 22*b* are inserted into an upper engaging slit 50 and a lower engaging slit 51, respectively, formed on upper and lower walls of each opening 15 at the terminal-inserting side (X) thereof and engaged by each of the upper engaging slit 50 and the lower engaging slit 51. In this manner, the terminal 11 can be inserted into the housing 10 at a predetermined distance and held at a predetermined position.

Referring to FIG. 1, the slide member 12 is inserted into the housing 10 from the direction (Y) opposite to the terminal-inserting side (X). A pressing portion 28 integral with the slide member 12 projects from the upper surface of a base portion 27 of the slide member 12 toward the housing 10. A pair of holding portions 29 integral with the slide member 12 is disposed at both ends of the base portion 27 in the longitudinal direction (W) thereof. The holding portion 29 serves as a means for holding the slide member 12 in the housing 10.

Figure 5:
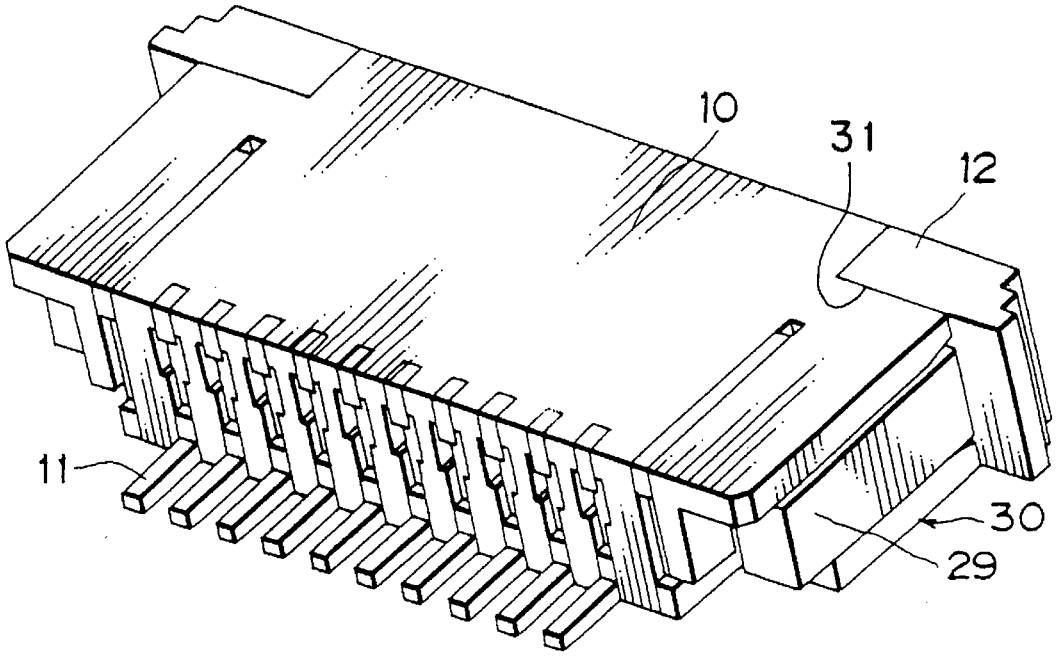
FIG. 5 is a perspective view showing the state in which the connector according to the first embodiment has been assembled.

Referring to FIG. 5, the holding portion 29 is locked at a temporary locking position and a main locking position of an installing portion 30 formed at both sides of the housing 10 in the longitudinal direction (W) thereof.

The thin pressing portion 28 is inserted into the space between the contact arm 20 of the terminal 11 and positioning arm 21 thereof from the direction (Y) so that the pressing portion 28 presses the flat cable 3 by the upper surface thereof and hence the conductor 2 is elastically brought into contact with the contact portion 24 of the contact arm 20.

Figure 4A:
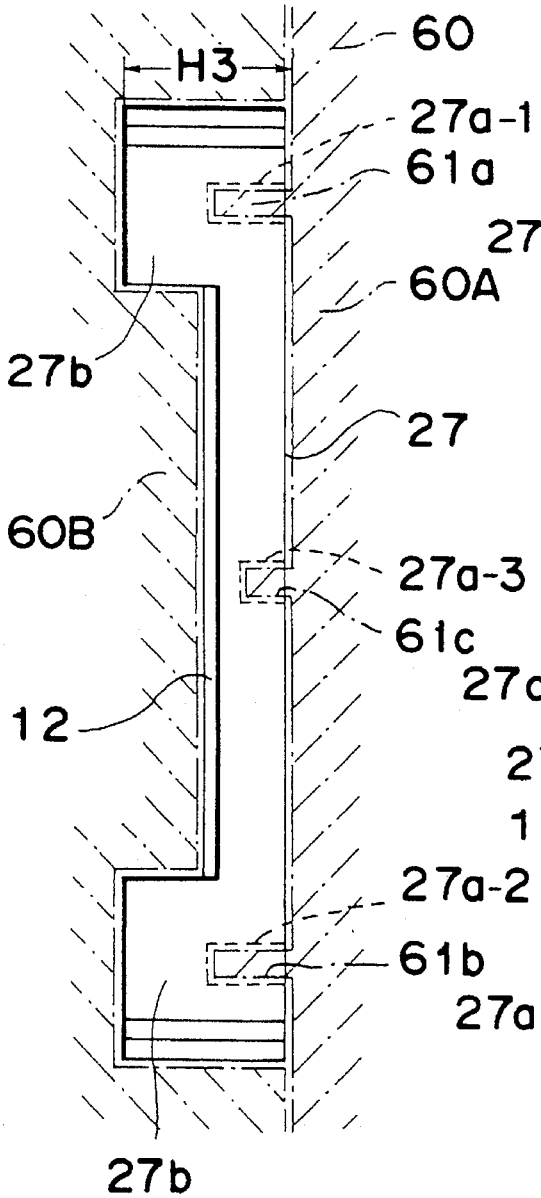
FIG. 4A is a rear elevation showing a slide member according to the first embodiment.
Figure 4B:
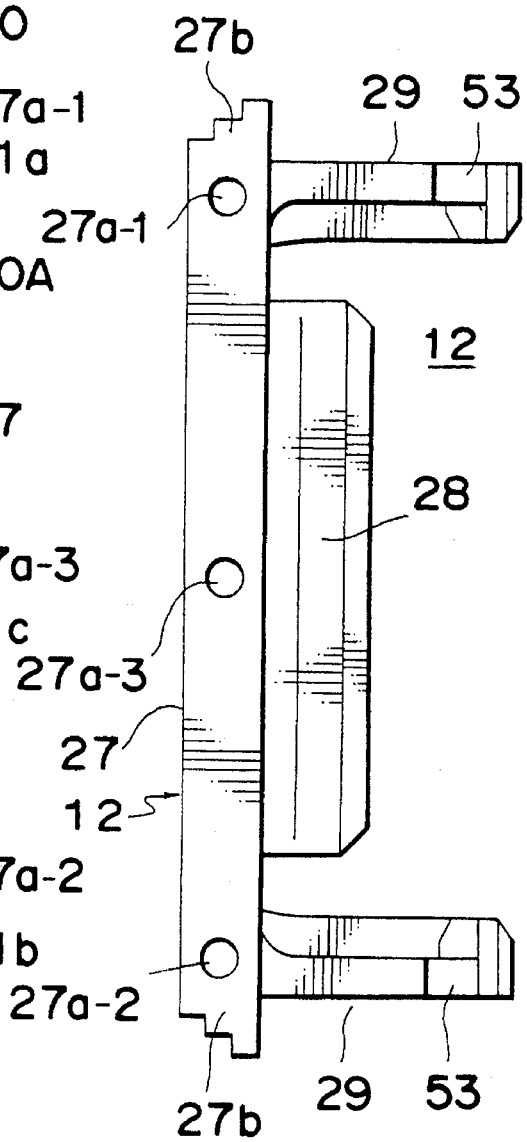
FIG. 4B is a bottom view showing the slide member according to the first embodiment.
Figure 4C:
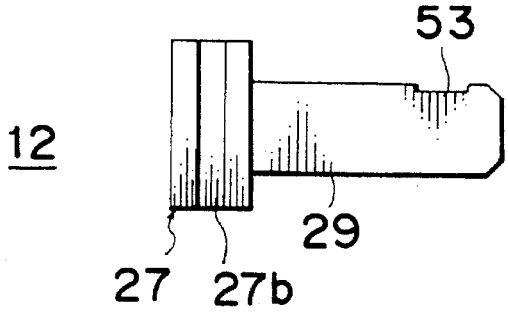
FIG. 4C is a side view showing the slide member according to the first embodiment.

Referring to FIGS. 4A, 4B, and 4C, insulating resin reinforced by glass fiber is shaped into the one-piece slide member 12 by a mold 60 comprising a pair of a mold 60A and a mold 60B. Projections 61 (61A, 61B, and 61C) are formed in the mold 60A so as to form circular holes 27*a* (27*a*-1, 27*a*-2, and 27*a*-3) on the bottom surface of the base portion 27 of the slide member 12.

The holes 27*a* are formed upward into the base portion 27 from the bottom thereof. The diameters of the holes 27*a*-1, 27*a*-2, and 27*a*-3 are equal to each other while the depths of the holes 27*a*-1 and 27*a*-3 are greater than that of the center hole 27*a*-2.

The number of the holes 27*a* and the positions thereof are not limited to the above-described ones but preferably, the holes 27*a* are formed symmetrically with respect to the center of the slide member 12 in the longitudinal direction thereof and designed so that the intermediate portion of the slide member 12 is not flexed irrespective of the length of the slide member 12.

The height H3 of both end portions 27*b* is set to be equal to the height H4 of the housing 10. As shown in FIG. 5, when the slide member 12 is installed in the housing 10, the end portions 27*b* engage each of a pair of engaging portions 31 formed at both ends of the housing 10 in the longitudinal direction thereof.

Figure 6A:
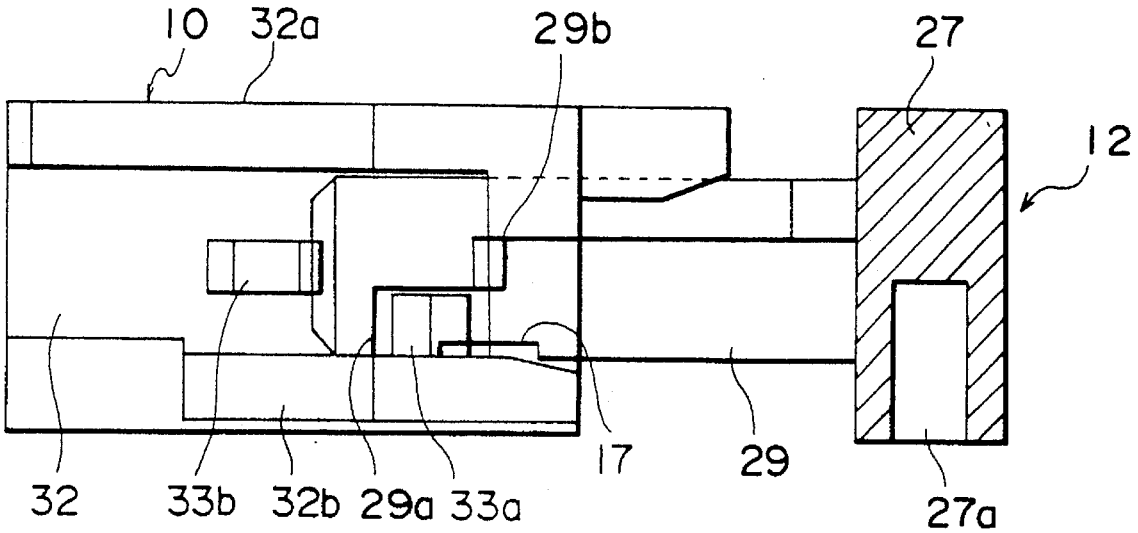
FIGS. 6A and 6B are sectional views showing the state in which the slide member is installed in a housing according to the first embodiment.
Figure 6B:
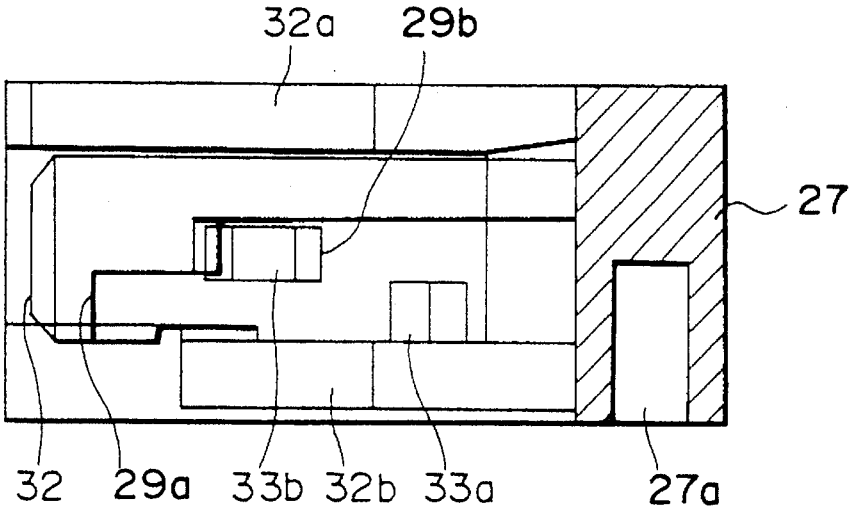

As shown in FIG. 6(A), the holding portion 29 projecting from the end portions 27*b* of the slide member 12 is inserted into an installing portion 32 disposed between a pair of upper and lower sandwiching strips 32*a* and 32*b* formed at both ends of the housing 10 in the longitudinal direction thereof so that a groove 29*a* and a groove 29*b* formed on the inner side of the holding portion 29 is locked by a temporary locking projection 33*a* of the housing 10 and a main locking projection 33*b* thereof, respectively.

As shown in FIG. 4C, a cut-out concave portion 53 is formed on the bottom surface of the holding portion 29 in the vicinity of the leading end thereof so that an ejector pin (not shown) is pressed against the concave portion 53.

The pressing portion 28 of the slide member 12 projects from the intermediate portion of the base portion 27 and the upper surface of the pressing portion 28 is positioned at a same height as that of the intermediate portion. The leading end portion of the pressing portion 28 inclines downward. When the slide member 12 is inserted into the housing 10, the pressing portion 28 presses the flat cable 3 by the upper portion thereof, thus bringing the conductor 2 of the flat cable 3 into contact with the contact arm 20 of the terminal 11.

The method of assembling the connector from the terminal 11, the flat cable 3, the housing 10, and the slide member 12 is described below.

As shown in FIG. 3, each terminal 11 is inserted into each opening 15 of the housing 10.

At this time, the contact arm 20 of the terminal 11 and the positioning arm 21 thereof are inserted into the upper opening 17 and the lower opening 18 of the opening 15, respectively from the side (X).

When the terminal 11 is inserted into the opening 18, the first and second projection 25 and 26 of the positioning arm 21 are moved into the housing 10 in sliding contact with the lower surface of the intermediate wall 19. The height H2 of the second projection 26 is greater than the height H1 of the first projection 25. Therefore, even though the intermediate wall 19 is worn by the friction between first projection 25 and the intermediate wall 19, the second projection 26 backward of the first projection 25 is in close sliding contact with the lower surface of the intermediate wall 19, thus arriving at a predetermined stop position in the housing 10. Thus, the terminal 11 can be stopped and held at a predetermined position in the housing 10.

At this time, the upper engaging projection 22*a* of the terminal 11 and the lower engaging projection 22*b* thereof are inserted into the upper slit 50 of the housing 10 and the lower slit 51 thereof and locked at a predetermined position, respectively.

In this manner, the most forward position of the terminal 11 can be correctly regulated and thus the terminal 11 can be securely placed in position inside the housing 10.

Since a plurality of terminals 11 can be inserted into each opening 15 in the same distance, every terminal 11 can press every conductor 2 of the flat cable 3 at a uniform pressure. The upper and lower engaging projections 22*a* and 22*b* can be seen from the outside of the housing 10. Therefore, an erroneous inserted position of the terminal 11 can be easily detected.

Then, the slide member 12 is inserted into the housing 10 from the side (Y), and the holding portion 29 is temporarily locked by the installing portion 30.

Thereafter, the flat cable 3 is inserted into the space between the contact arm 20 of the terminal 11 and the positioning arm 21 thereof along the upper surface of the pressing portion 28 of the slide member 12.

Then, the slide member 12 is pressed into the main locking position. When the flat surface of the pressing portion 28 is located at a position opposed to the contact portion 24 of the contact arm 20, the conductor 2 of the flat cable 3 is elastically brought into contact with the contact portion 24. A reinforcing plate 58 is fixed at the lower surface of the flat cable 3, thus the flat cable 3 is pressed by the pressing portion 28 through the reinforcing plate 58.

As described previously, since the projections 24*a* and 24*b* are projecting widthwise in opposite directions on the lower surface of the leading end of the contact arm 20 so as to make the surface area of the contact portion 24 about twice as large as that of the thickness of the contact arm 20, the contact portion 24 contacts the conductor 2 in a large area. Therefore, even though the conductor 2 is dislocated at approximately 0.2 mm to 0.5 mm from the predetermined insertion position, the conductor 2 is allowed to reliably contact the contact portion 24.

The holes 27*a* are formed on the base portion 27 at required positions in the longitudinal direction thereof. Accordingly, the pressing portion 28 is not flexed in the longitudinal direction thereof, even though a length of the pressing portion in the longitudinal direction is very long. Consequently, the pressing force of the pressing portion 28 is uniformly applied to the contact portion 24 in the longitudinal direction of the housing 10. Thus, the terminal 11 and the conductor 2 can be securely connected to each other in each opening 15.

Further, even though a burr is generated on the concave portion 53 of the base portion 27 due to the pressing force of the ejector pin, the burr does not project from the concave portion 53. Therefore, when the holding portion 29 is inserted into the installing portion 32 of the housing 10, the slide member 12 can be locked in the housing 10 with the holding portion 29 in close contact with the installing portion 32.

The connector according to the present invention is not limited to the first embodiment, but various modifications can be made.

For example, the two projections 24*a* and 24*b* are projecting widthwise in opposite directions on the leading end of the contact arm 20 to form the contact portion 24, but the contact portion 24 may comprise three projections or more.

Figure 7:
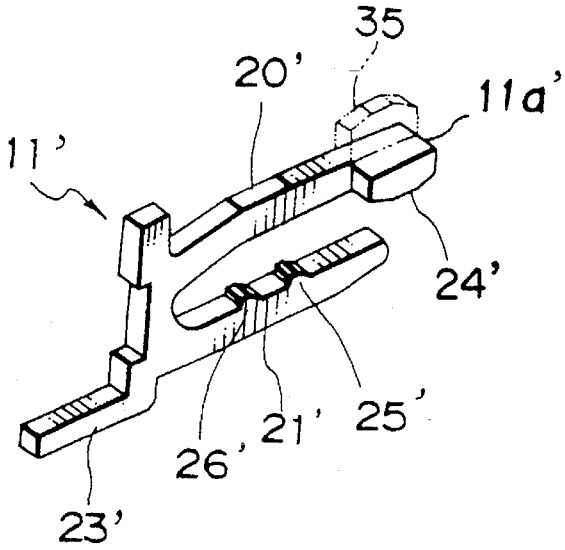
FIG. 7 is a perspective view showing a modification of the terminal.

Referring to FIG. 7, in forming the terminal 11' by pressing, a portion 35 in a configuration similar to that of an end portion 11*a'* of a contact arm 20' is formed on the upper end of the end portion of the contact arm 20' by punching as shown by two-dot chain line of FIG. 7. Then, the portion 35 is bent and shaped by pressing so that the bent portion 35 is adjacent to the end portion 11*a'* in the width direction thereof. Thereafter, the bent portion 35 is integrated with the end portion 11*a'* so as to form a contact portion 24'.

A connector according to a second embodiment of the present invention is described below with reference to FIGS. 8 through 12. A connector 4 is soldered to a base plate 9 and the connector 4 is placed in position on the base plate 9 by using an automatic chuck.

In the second embodiment, a pair of U-shaped holders 54 is used to fix the connector 4 to the base plate 9. A pair of cut-out openings 55 is provided in the vicinity of both ends of the housing 10 in the longitudinal direction thereof from the terminal-inserting side (X) of the housing 10 toward the slide member-inserting side (Y). Each opening is formed by cutting out the housing in U-shaped configuration. The holder 54 is also U-shaped so that the holder 54 is inserted into the cut-out opening 55. The holder 54 comprises an upper arm 54*a*; a lower arm 54*b*; a connecting portion 54*c* connecting the upper arm 54*a* and the lower arm 54*b*; and a projection 54*d* formed on the connecting portion 54*c* projecting outward therefrom.

A concave portion 54*e* for storing solder is formed on the bottom surface of the lower arm 54*b*.

Figure 9:
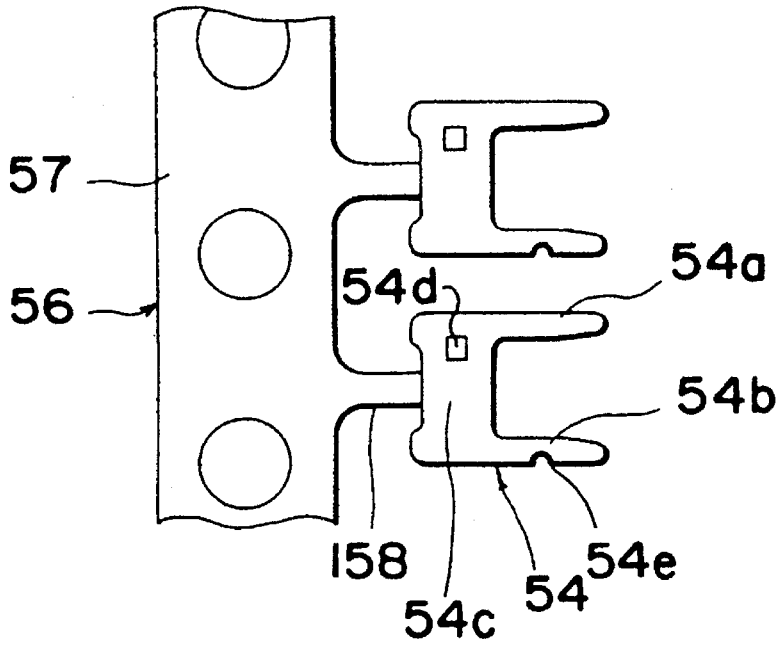
FIG. 9 is a view showing the process of manufacturing a holder according to the second embodiment of the present invention.

Referring to FIG. 9, the holder 54 is formed by punching a conductive metal plate 56 having a thickness equal to that of the terminal 11. The holders 54 are formed by punching the metal plate 56 in parallel with each other via a connecting portion 158 connecting a carrier 57 and the holder 54. Therefore, the thickness T2 of the holder 54 is equal to that T1 of the terminal 11.

Figure 8:
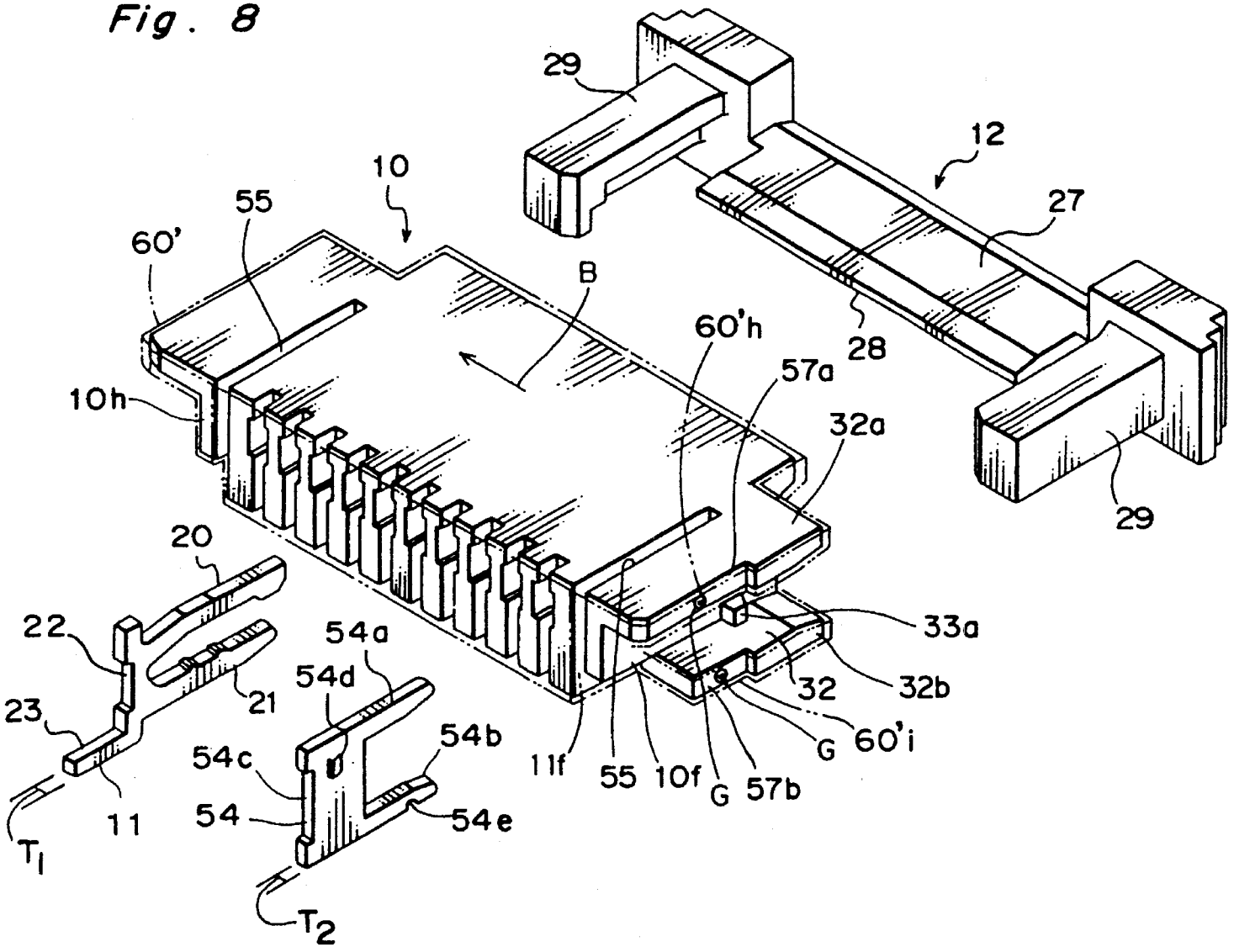
FIG. 8 is an exploded perspective view showing a connector according to a second embodiment of the present invention.

Referring to FIG. 8, a pair of slide member-installing portions 32 project from each of both side walls 10*f* and 10*h* of the housing 10. The side walls 10*f* and 10*h* are disposed at both ends of the housing 10 in the longitudinal direction thereof. Upper and lower sandwiching portions 32*a* and 32*b* of the right installing portion 32 are cut widthwise from the terminal-inserting side (X) to form stepped concave portions 57*a* and 57*b*.

The housing 10 according to the second embodiment is formed by injecting insulating resin into a mold 60' shown by a two-dot chain line of FIG. 8.

The housing 10 accommodates a plurality of terminal-receiving openings 15 arranged in parallel with each other as shown in FIG. 8. Therefore, normally, the resin is flowed in a direction shown by an arrow (B), namely, from the side wall 10*f* to the side wall 10*h* so as to flow the resin smoothly in the mold 60' and prevent a shrinkage cavity from being formed. In the second embodiment, in order to form the housing 10, gate positions (G) are set on the concave portions 57*a* and 57*b* so as to inject resin into the mold 60' from resin-injecting holes 60'*h* and 60'*i* corresponding to each gate position (G).

Although two gate positions (G) are formed on the housing 10 in the second embodiment, one gate position (G) may be formed to form the housing 10.

Figure 10A:
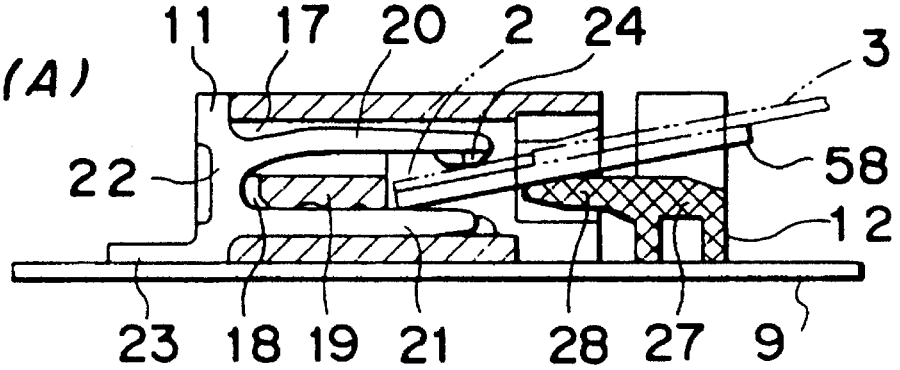
FIGS. 10A and 10B are sectional views showing the process of assembling the connector according to the second embodiment.
Figure 10B:
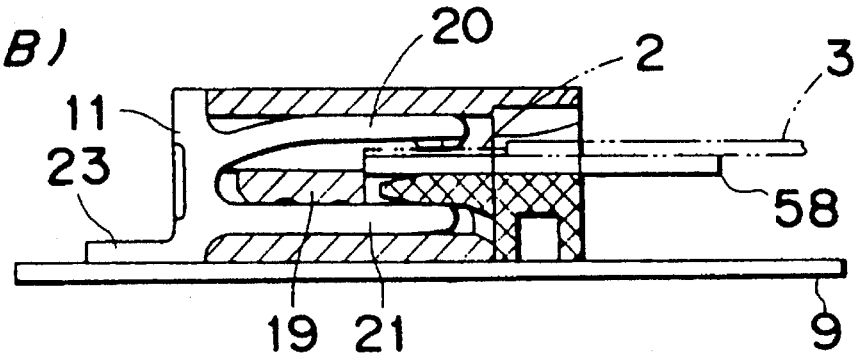

The conductor 2 is sandwiched between insulating films or sheets similarly to the conventional art, and an upper insulating film is cut at the leading end thereof to expose a conductor to the outside. The reinforcing plate 58 is fixed to the lower surface of a lower insulating film as shown in FIGS. 10A and 10B.

The method of installing the connector on the base plate and connecting the terminal and the flat cable to each other are described below.

First, the terminal 11 is inserted into the opening 15 of the housing 10, and the holder 54 is inserted into the cut-out opening 55.

When the holder 54 inserted into the cut-out opening 55 is in the vicinity of the insertion completion position, the projection 54*d* formed on the connecting portion 54*c* is pressed against the vertical inner surface of the housing 10, thus being tightly fixed to the cut-out opening 55. Upon completion of the insertion of the holder 54, the lower surface of the lower arm 54*b* of the holder 54 becomes flush with the lower surface of the housing 10, and the upper surface of the upper arm 54*a* of the holder 54 becomes flush with the upper surface of the housing 10.

The holding portion 29 of the slide member 12 is inserted into the installing portion 32 of the housing 10 to fix the slide member 12 to the housing 10.

Then, the housing 10 is mounted on the base plate 9 with the terminal 11, the slide member 12, and the holder 54 installed therein.

Figure 11:
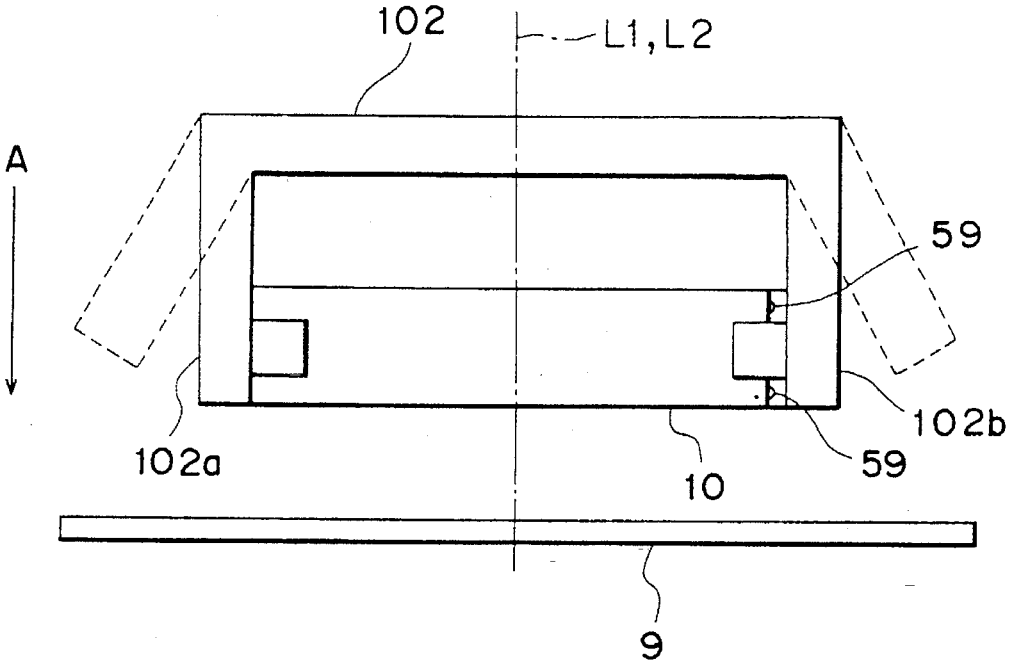
FIG. 11 is a schematic view showing the state in which the connector according to the second embodiment is placed on a base plate by an automatic machine.
Figure 12:
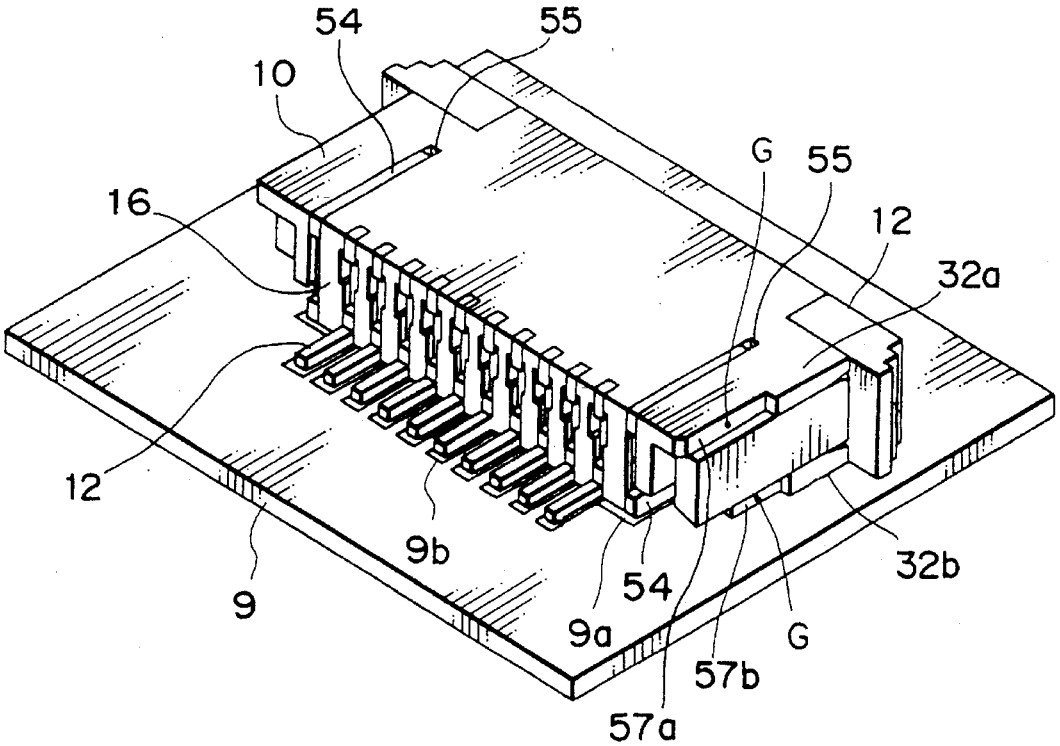
FIG. 12 is a perspective view showing the state in which the connector according to the second embodiment has been fixed to the base plate.
Figure 16:
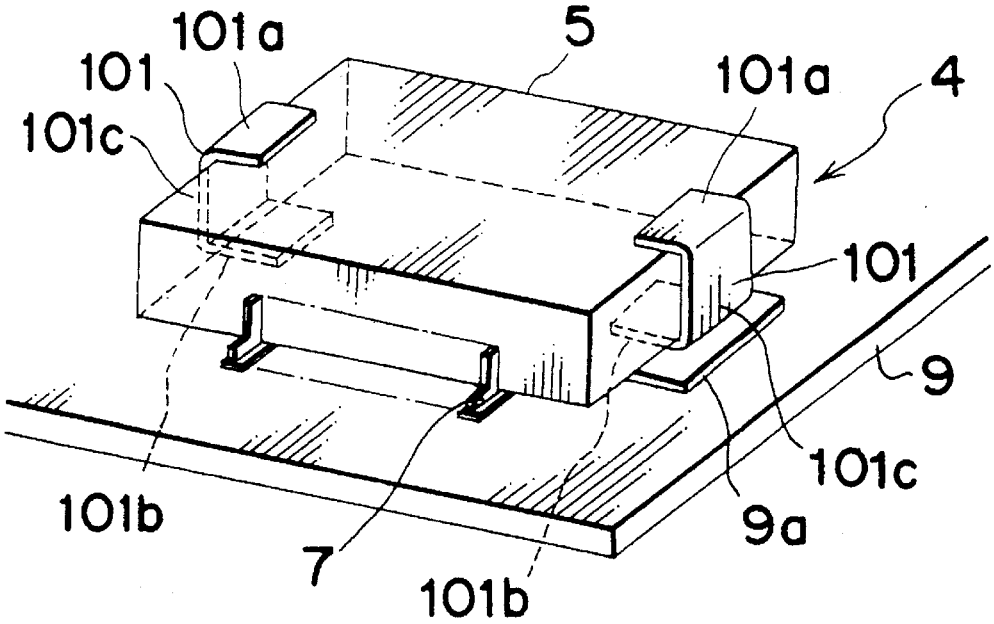
Fig. 16 PRIOR ART
FIG. 16 is a perspective view showing a conventional connector mounted on a base plate.
Figure 17:
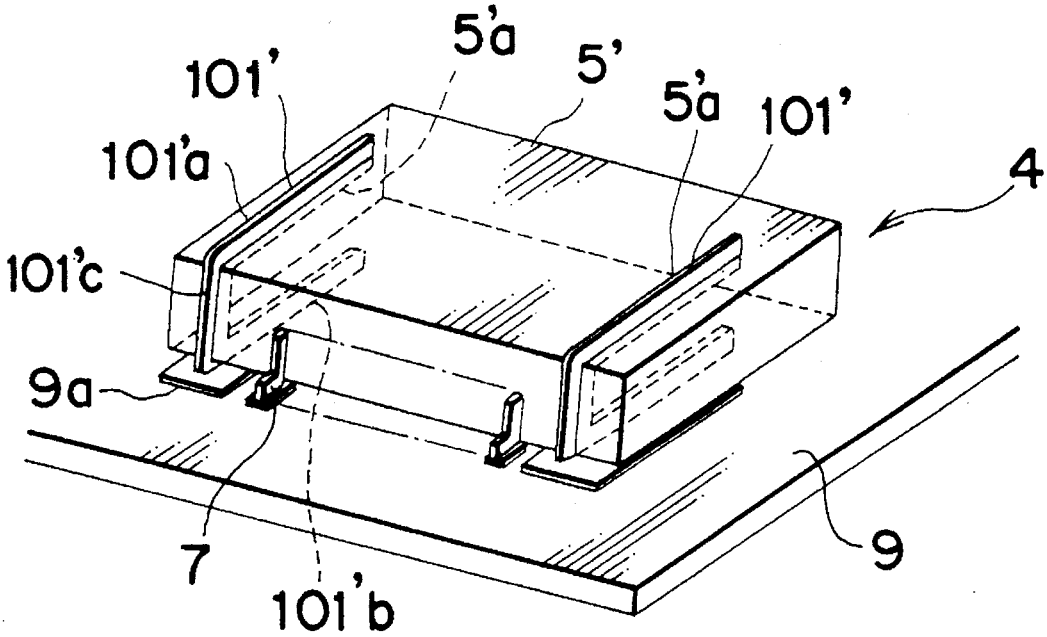
Fig. 17 PRIOR ART
FIG. 17 is a perspective view showing another conventional connector mounted on the base plate.
Figure 18:
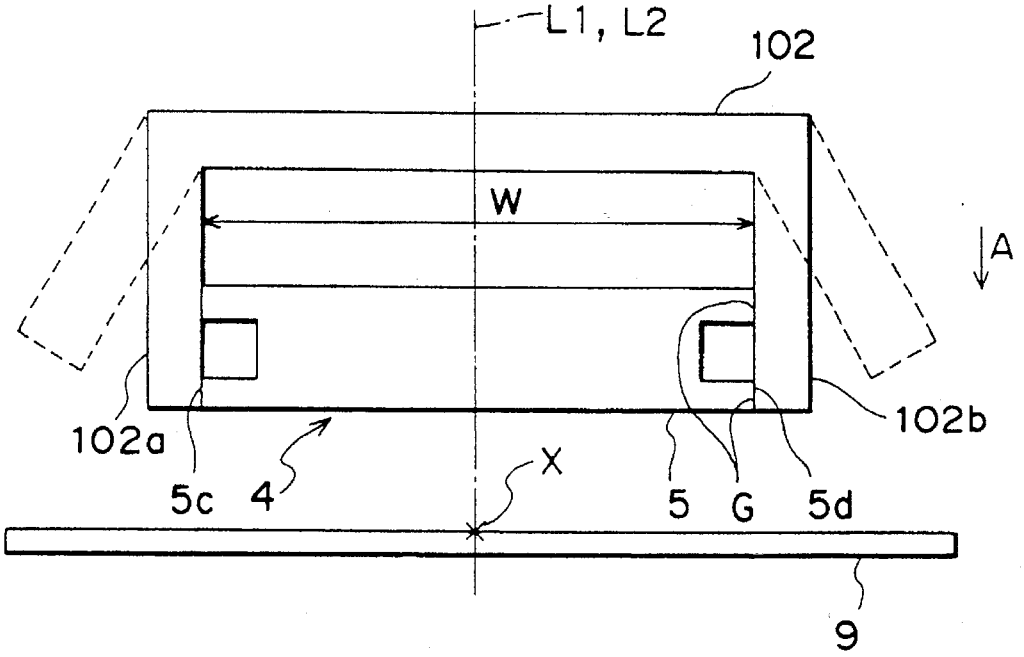
Fig. 18 PRIOR ART
FIG. 18 is a schematic view showing an operation of placing a conventional connector on the base plate by an automatic machine.
Figure 19:
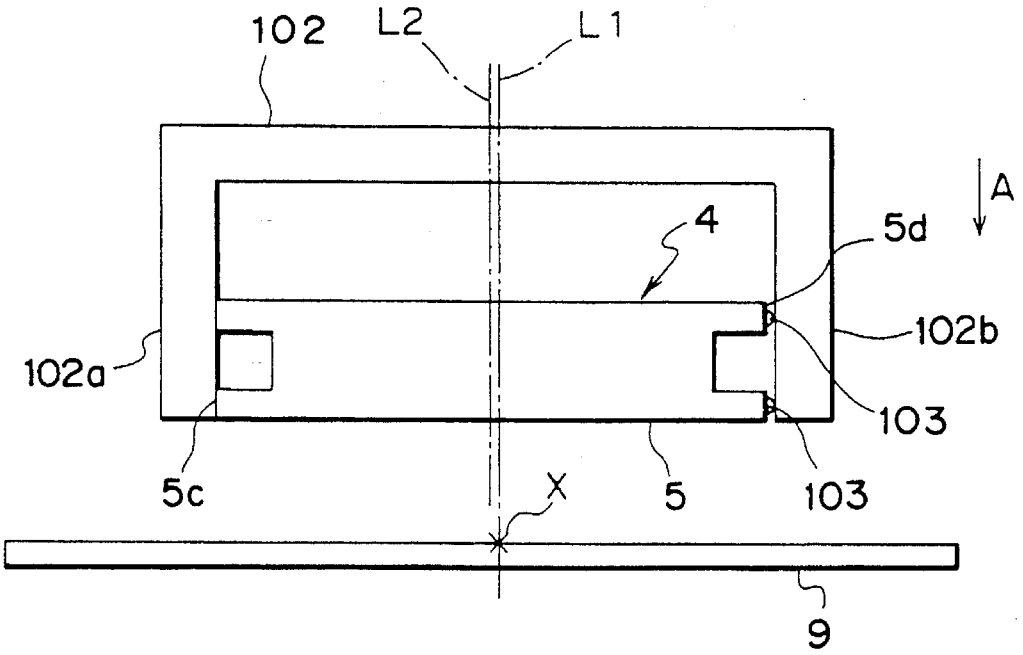
Fig. 19 PRIOR ART
FIG. 19 is a schematic view showing a problem of the conventional connector of FIG. 18 in installing the connector on the base plate.

As shown schematically in FIG. 11, the end surface of upper and lower portions 32*a* and 32*b*, namely, the right and left end surfaces of the housing 10 are sandwiched by arms 102*a* and 102*b* of an automatic chuck 102. The concave portions 57*a* and 57*b* do not contact the arm 102*b* owing to the above-described configuration. Even though gate remainders 59 are formed on the gate position (G) set on the concave portions 57*a* and 57*b*, the gate remainders 59 do not contact the arm 102*b* either. Accordingly, in the connector according to the second embodiment, the center L1 of the chuck 102 and the center L2 of the housing 10 coincide with each other.

Then, the center L1 of the chuck 102 is made to be coincident with the housing-installing position (X) set on the base plate 9. As a result, the center L2 of the housing 10 coincides with the housing-installing position (X). In this manner, the housing 10 can be placed in position on the base plate 9.

Thereafter, the chuck 102 is moved toward the base plate 9 as shown by an arrow (A) of FIG. 11 to mount the housing 10 on the base plate 9.

The lower surface of the housing 10 is brought into contact with the upper surface of the base plate 9, and the lower surface of the lower arm 54*b* of the holder 54 flush with the lower surface of the housing 10 is placed on a pad 9*a* disposed on the base plate 9. The lower surface of the lead portion 23 of each terminal 11 projecting from the housing 10 is brought into contact with the upper surface of a pad 9*b* disposed on the base plate 9.

Then, the lower surface of the holder 54 and that of the lead portion 23 are soldered with the pad 9*a* and the pad 9*b*, respectively.

Since the concave portion 54*e* is formed on the bottom surface of the lower arm 54*b* of the holder, solder is stored in the concave portion 54*e* in a soldering operation. Thus, even though the lower arm 54b is thin, the arm 54b can be soldered to the base plate 9 reliably.

The flat cable 3 is inserted into the opening 15 of the housing 10 by using the slide member 12 so as to connect the flat cable 3 to the terminal 11, with the housing 10 fixed to the base plate 9.

That is, referring to FIG. 10A, the slide member 12 is returned to temporary locking position of the housing 10. Then, the flat cable 3 is inserted between the contact arm 20 of the terminal 11 and the positioning arm 21 along the upper surface of the slide member 12.

Thereafter, the slide member 12 is pressed to dispose it at the main locking position. As a result, the pressing portion 28 brings the flat cable 3 into contact with the contact arm 20 elastically. In this manner, the terminal 11 and the flat cable 3 are connected with each other.

As described above, the gate positions are formed on the concave portions of the housing. Therefore, even though gate remainders are formed on the gate positions, the gate remainders do not contact the arm of the chuck. Accordingly, the center of the chuck and the center of the housing coincide with each other. Then, the center of the chuck is made to be coincident with the housing-installing position set on the base plate. As a result, the center of the housing coincides with the housing-installing position. In this manner, the housing can be placed in position on the base plate.

The holder for fixing the housing to the base plate and the forked terminal are punched out from the same metal plate. Therefore, the holder can be manufactured at a low cost. Moreover, the holder can be shaped to be as thick as the terminal. Therefore, a compact housing can be manufactured.

The projection formed on the holder is pressed against the inner surface of the housing. Thus, the holder can be tightly fixed to the housing.

The holder is thin but the concave portion for storing solder is formed on the bottom surface thereof. Thus, the holder can be soldered to the base plate at a high strength.

As described above, in the connector according to the present invention, there is formed a contact portion, comprising a pair of projections formed widthwise in opposite directions, on the lower surface of the leading end of the contact arm to make the contact area of the contact portion large. Therefore, even though the conductors of the flat cable are dislocated more or less from a predetermined insertion position, the conductor is allowed to reliably contact the contact portion of the terminal. That is, although the conductor is circular and thus the contact area is small, the conductor can be reliably brought into contact with the contact arm of the terminal.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A connector comprising a plurality of terminals, a flat cable provided with a plurality of conductors to be connected with the terminals, an insulating housing into which the terminals and the flat cable are inserted in opposition to each other, and a slide member for pressing each conductor of the flat cable against each terminal, wherein:

each terminal is a conductive metal plate having a forked configuration and comprises a contact arm, a positioning arm projecting horizontally and in parallel to and in the same direction as said contact arm from one side of a vertical connecting portion thereof, and a contact portion having a large area formed on a lower surface of a leading end of the contact arm, said contact portion including a plurality of projections extending in opposite directions from the lower surface of the leading end of the contact arm;

the insulating housing is integrally made of resin and comprises a plurality of slit-shaped through-openings, extending horizontally and arranged in parallel with each other in the widthwise direction thereof, for receiving terminals from an opening portion disposed at one side thereof and receiving the flat cable and the slide member from an opening portion disposed at an other side thereof, the through-openings communicating with each other; and an intermediate wall extending from a terminal-inserting side of the housing into each through-opening, thus partitioning each through-opening into an upper opening for receiving the contact arm of the terminal and having a width large enough for the contact portion of each terminal to be inserted therethrough, and a lower opening for receiving the positioning arm of the terminal, the flat cable comprises a flexible insulating sheet and a plurality of conductors spaced at regular intervals in parallel with each other on the flexible insulating sheet, said flat cable being inserted into the housing from the opening portion disposed at the other side of the through-openings so that the flat cable is disposed between the contact arm and the positioning arm, and the slide member is integrally made of resin and is inserted between the flat cable and the positioning arm of each terminal, and elastically presses the flat cable against the contact portion of the contact arm.

2. The connector as defined in claim 1, wherein the width of the lower opening for receiving the positioning arm is smaller than that of the upper opening for receiving the contact arm.

3. The connector as defined in claim 1, wherein each terminal includes a first projection and a second projection both formed on one of an upper surface of the positioning arm and a lower surface of the positioning arm in such a manner that the first projection is disposed at an inserting side into the housing, the second projection is disposed rearward of the first projection, and a height of the first projection is smaller than a height of the second projection.

4. A connector comprising a plurality of terminals, a flat cable provided with a plurality of conductors to be connected with the terminals, an insulating housing into which the terminals and the flat cable are inserted in opposition to each other, a slide member for pressing each conductor of the flat cable against each terminal, a base plate on which the housing is installed, and a pair of metal holders installed in the housing, for fixing the housing to the base plate, wherein:

each terminal is a conductive metal plate having a forked configuration, and comprises a contact arm and a positioning arm project horizontally and in parallel to and in the same direction as said contact arm from one side of a vertical connecting portion of the terminal, the insulating housing is integrally made of resin and comprises a plurality of slit-shaped through-openings, extending horizontally and arranged in parallel with each other in the widthwise direction thereof, for receiving terminals from an opening portion disposed at one side thereof and receiving the flat cable and the slid member from an opening portion, disposed at an other side thereof, the through-openings communicating with each other; and an intermediate wall extending from a terminal-inserting side of the housing into each through-opening, thus partitioning each through-opening into an upper opening for receiving the contact arm of the terminal and a lower opening for receiving the positioning arm of the terminal, and a pair of cut-out openings formed in the vicinity of both outer side surfaces of the housing in the longitudinal direction thereof, the flat cable comprises a flexible insulating sheet and a plurality of conductors spaced at regular intervals in parallel with each other on the flexible insulating sheet, said flat cable being inserted into the housing from the opening portion disposed at the other side of the through-openings so that the flat cable is disposed between the contact arm and the positioning arm, the slide member is integrally made of resin and is inserted between the flat cable and the positioning arm of each terminal, and elastically presses the flat cable against the contact portion of the contact arm, and the holders each include a metal plate and are inserted into a respective cut-out opening of the housing, a projection extending from the metal plate, so that when the holder is inserted into the respective cut-out opening, the projection is pressed against an inner surface of the housing, a lower surface of the holder being flush with a bottom surface of the housing and being soldered to the base plate.

5. The connector as defined in claim 4, wherein the holders each include a metal plate having a thickness equal to that of a metal plate of the terminal.

6. The connector as defined in claim 4, wherein the holder includes a concave portion on a lower surface thereof, so that the holder may be soldered to the base plate.

7. The connector as defined in claim 5, wherein the holder includes a concave portion on a lower surface thereof, so that the holder may be soldered to the base plate.

* * * * *

UNITED STATES PATENT AND TRADEMARK OFFICE

CERTIFICATE OF CORRECTION

PATENT NO. : 5,474,468

DATED : December 12, 1995

INVENTOR(S) : M. CHISHIMA et al.

It is certified that error appears in the above-indentified patent and that said Letters Patent is hereby corrected as shown below:

At column 15, line 4 (claim 4, line 20), change "slid" should be changed to ---slide---.

Signed and Sealed this

Sixteenth Day of July, 1996

Bruce Lehman

*Attest:*

BRUCE LEHMAN

*Attesting Officer*

*Commissioner of Patents and Trademarks*